United States Patent [19]

Sasaoka et al.

[11] Patent Number: 4,873,173

[45] Date of Patent: Oct. 10, 1989

[54] METHOD OF FORMING IMAGE PROVIDING A CHANGE IN SENSITIVITY BY ALTERING THE PH OF THE DEVELOPER

[75] Inventors: Senzo Sasaoka; Tetsuo Yoshida; Nobuaki Inoue, all of Kanagawa, Japan

[73] Assignee: Fuji Photo Film Co., Ltd., Kanagawa, Japan

[21] Appl. No.: 110,981

[22] Filed: Oct. 21, 1987

[30] Foreign Application Priority Data

Oct. 21, 1986 [JP] Japan ..... 61-249872

[51] Int. Cl.[4] ..... G03C 5/24; G03C 1/06

[52] U.S. Cl. ..... 430/964; 430/265; 430/434; 430/436; 430/487; 430/598

[58] Field of Search ..... 430/264, 265, 266, 267, 430/434, 436, 437, 487, 598

[56] References Cited

U.S. PATENT DOCUMENTS

| | | | |
|---|---|---|---|
| 4,681,836 | 7/1987 | Inoue et al. | 430/434 |
| 4,737,442 | 4/1988 | Yagihara et al. | 430/264 |
| 4,755,448 | 7/1988 | Katoh | 430/266 |
| 4,755,449 | 7/1988 | Inoue et al. | 430/267 |

FOREIGN PATENT DOCUMENTS

| | | | |
|---|---|---|---|
| 0217260 | 4/1987 | European Pat. Off. | 430/264 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method of forming an image is provided. The method comprises the steps of (a) imagewise exposing a photographic material which comprises a support having provided thereon at least one light-sensitive silver halide emulsion layer and which contains a hydrazine compound represented by the following general formula (I) in the emulsion layer or a hydrophilic colloid layer adjacent thereto, the photographic material being designed so that a difference in sensitivity (sensitivity being defined as log E corresponding to the density of fog+2.0) between (1) the photographic material is development-processed with a developing solution having a sulfite ion concentration of 0.15 mole/l or more, a potassium ion concentration of 0.2 mole/l or more and a pH value ranging from 10.5 to 12.3 and (2) the photographic material is development-processed with the same developing solution as described above, except that the pH value was lowered by 1.0, ($\Delta$log E), is 0.7 or less, and moreover, the gamma value obtained in (1) is 10 or more and the gamma value obtained in (2) is 5 or more:

(I)

wherein A represents an aliphatic group, or an aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxcarbonyl group, a sulfinamoyl group, an alkoxysulfonyl group, a thioacyl group, a thiocarbamoyl group, a sulfamoyl group, or a heterocyclic group; both $R_0$ and $R_1$ represent a hydrogen atom, or one of them represents a hydrogen atom and the other represents an alkysulfonyl group, an arylsulfonyl group, or an acyl group; and B, $R_1$ and the nitrogen atom attached thereto may form a partial structure of hydrazone, and (b) developing the exposed material with a developer. The method realizes superhigh contrast and high resolution images.

10 Claims, No Drawings

METHOD OF FORMING IMAGE PROVIDING A CHANGE IN SENSITIVITY BY ALTERING THE PH OF THE DEVELOPER

FIELD OF THE INVENTION

The present invention relates to a method of forming images of superhigh contrast and high resolution with wide exposure latitude which can be employed in the field of photomechanical processes.

BACKGROUND OF THE INVENTION

It is well known that photographic images of extremely high contrast can be formed using certain kinds of silver halides, and methods of forming such photographic images are employed in the field of photomechanical processes. For example, there is known a method of forming superhigh contrast negative images by processing a silver halide photographic material of the kind which forms latent images predominantly at the surface of the grains, to which a hydrazine derivative (one of the specified acylhydrazine compounds as described in U.S. Pat. Nos. 4,166,742, 4,168,977, 4,211,857, 4,224,401, 4,243,739, 4,272,606 and 4,311,781) is added, with a developing solution adjusted to pH 11.0 to 12.3 and containing a sulfite preservative in a concentration of 0.15 mol/l or more.

According to the foregoing method, superhigh contrast as expressed by a gamma value of above 10 can be achieved. However, the method has a defect in that fine lines become difficult to reproduce as the exposure is decreased beyond a certain limit, because the characteristic curve of the photosensitive material used shows a sharp decrease in the toe portion. More specifically, when a letter original is photographed using a superhigh contrast photosensitive material of the kind which shows a sharp decrease in a toe portion of its characteristic curve with the camera set for a condition of underexposure, it is hard to read the developed image as letters due to a sudden drop in density of the letter image. Accordingly, such a high contrast photosensitive material suffers from the defect that its latitude in variation of exposure is narrow.

Comparatively low contrast photosensitive materials, such as those having a gamma value of below 10, do not exhibit the above-described defect. That is, there is no minimum exposure limit beyond which a sudden drop in density of letter image occurs in low contrast photosensitive materials, and the materials can gain densities high enough to be usable in the succeeding contact work even if the negative was exposed under a reduced exposure condition, and cyan provide images readable as letters. As described above, low contrast photosensitive materials have an advantage in that a latitude is extended to the low exposure side, but they have also a defect in that a high density of the background ($D_{max}$) is difficult to reproduce. More specifically, since a density of the white area of an original (corresponding to the black solid area in a negative film), $D_{max}$, becomes higher the higher the gamma value determined from the characteristic curve is, low contrast photosensitive materials suffer from a disadvantage of having low $D_{max}$ because their gamma values are low. The original characters for a block copy in the photographing of line originals may vary in density, background, and contrast, e.g., an original may be in part high in letter density and part low in letter density and contrast. For example, characters of Mingcho type (thin in line width), letters of Gothic type (thick in line width), a white, black, or colored background, and so on, may be present as a mixture in an original. Various areas of such originals would be different from one another in correct exposure setting.

When a block copy composed of those originals differing in correct exposure is intended to be photographed, the use of a photosensitive material narrow in exposure latitude makes the selection of exposure condition very difficult. Sometimes, all of the originals cannot be reproduced in a satisfactory condition by photographing at once, so the block copy is divided into some areas and partial photographing is carried out for each area under a properly adjusted exposure condition.

More specifically, when an exposure is lowered in order to reproduce black fine lines of an original, there occurs a problem that a density of the background (which corresponds to the black solid areas of the negative film, and is represented as $D_{max}$) becomes low, and white fine lines (white lines in a black solid area) of the original become too thin to be reproduced. On the other hand, raising an exposure causes a problem that black lines of the original become too thin to be reproduced. Therefore, it has been desired to develop a photosensitive material having a wide exposure latitude and a high background density ($D_{max}$) in photographing of line originals.

SUMMARY OF THE INVENTION

An object of the present invention is to provide an image-forming method which ensures a wide exposure latitude, superhigh contrast and high resolution in photographing of line originals.

Another object of the present invention is to provide an image-forming method which can reproduce line originals in a satisfactory condition, and ensure high background density ($D_{max}$) and superhigh contrast.

The above-described objects are attained with a method of forming an image comprising the steps of (a) imagewise exposing a photographic material which comprises a support having provided thereon at least one light-sensitive silver halide emulsion layer and which contains a hydrazine compound represented by the general formula (I) illustrated hereinafter in the emulsion layer or a hydrophilic colloid layer adjacent thereto, the photographic material being designed so that a difference in sensitivity (sensitivity being defined as log E corresponding to the density of fog +2.0) between (1) the photographic material is development-processed with a developing solution having a sulfite ion concentration of 0.15 mole/l or more, a potassium ion concentration of 0.2 mole/l or more, and a pH value ranging from 10.5 to 12.3, and (2) the photographic material is development-processed with the same developing solution as described above, except that the pH value is lowered by 1.0, ($\Delta$ log E), is 0.7 or less, and moreover, the gamma value obtained in (1) is 10 or more and the gamma value obtained in (2) is 5 or more:

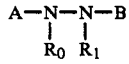

(I)

wherein A represents a substituted or unsubstituted aliphatic group, or a substituted or unsubstituted aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, a sulfamoyl group, or a heterocyclic group; both $R_0$ and $R_1$ represent a hydrogen atom, or one of them represents a hydrogen atom and the other represents a substituted or unsubstituted alkylsulfonyl group, a substituted or unsubstituted arylsulfonyl group, or a substituted or unsubstituted acyl group; and B, $R_1$ and the nitrogen atom attached thereto may form a partial structure of hydrazone,

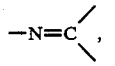

and (b) developing the exposed material with a dveloper.

DETAILED DESCRIPTION OF THE INVENTION

Superhigh contrast development is imparted by active species of a hydrazine derivative. More specifically, when development takes place in an image area, a product yielded by oxidation of a developing agent reacts with a hydrazine derivative to form an active species. This active species brings about infectious development to produce superhigh contrast. However, the overproduction of the active species causes thickening of line width, blur, obscurity, etc. in photographing of line originals, and aggravates reproducibility of fine lines. Accordingly, in order to effect the improvement in latitude of exposure over which line originals may be faithfully reproduced, it is necessary to develop such a photosensitive material as to acquire superhigh contrast even when the active species is produced in a reduced amount.

Superhigh contrast development due to a hydrazine derivative is directly influenced by the pH of the developer used. When the pH of the developer is low, superhigh contrast development does not take place. Specifically, when the pH of a developer which can produce superhigh contrast gradation to be represented by $\gamma \geqq 10$ is lowered by 1.0, the resulting developer comes to lose the ability to bring about infectious development notwithstanding the presence of a hydrazine derivative, thus causing decreases in photographic speed and contrast. That is, the competency of the resulting developer falls into the same level as that of the developer having no hydrazine derivative. The gamma value obtained with a hydrazine containing material which is conventionally well-known in the case where the pH of the developer is decreased by 1.0 was below 5. Irrespective of the game value obtained in such a case, superhigh contrast to be represented by $\gamma \geqq 10$ can be attained by using a hydrazine derivative when development is carried out with a developer having a regular pH value. Under these circumstances, it is surprising to find that an exposure latitude of line originals depends upon both a gamma value obtained when the pH of the developer is lowered by 1.0 (when superhigh contrast development due to a hydrazine derivative is not able to take place) and a difference in sensitivity between the case where development is carried out with a developer having a pH value decreased from the original one by 1.0 and the case where development is carried out with the developer having the original pH ($\Delta$ log E at the point of fog+density 2.0). That is to say, it is found that a photosensitive material of the kind which has a sensitivity difference of below 0.7 when it is represented by $\Delta$ log E, or a difference between the sensitivity obtained when development is carried out using a developer whose pH is lower than the original by 1.0 and the sensitivity obtained when the development is carried out with the developer of the original pH value, and a gamma value of above 5 when the development is carried out with the developer whose pH is lower than the original by 1.0 can provide sufficiently high contrast and have an extended latitude in exposing line originals to light even when the active species of a hydrazine derivative is produced in a reduced amount. That is, the photosensitive material of the above described kind is found to have a desirable effect that contrast is high enough to be represented by $\gamma$ of 10 or above when developed under a pH of 10.5 to 12.3, and consequently $D_{max}$ is high, and at the same time a latitude of acceptable exposure for line originals is wide.

Next, the general formula (I) will be described in detail.

In the general formula (I), aliphatic groups represented by A are preferably the ones of 1 to 30 carbon atoms and, especially preferably, linear, branched, or cyclic alkyl groups of 1 to 20 carbon atoms. The branched alkyl group may be cyclized to form a saturated heterocyclic ring containing one or more hetero atoms. The alkyl groups may have a substituent group such as an aryl group, an alkoxy group, a sulfoxylic group, a sulfonamide group, a carboxylic acid amide group, or the like.

As the examples of the aliphatic group, there may be mentioned, a t-butyl group, an n-octyl group, a t-octyl group, a cyclohexyl group, a pyrrolidyl group, an imidazolidyl group, a tetrahydrofuryl group, a morpholino group, and the like.

The aromatic group represented by A in the general formula (I) is preferably a monocyclic or bicyclic aryl group or an unsaturated heterocyclic group. The unsaturated heterocyclic group may be condensed with a monocyclic or bicyclic aryl group to form a heteroaryl group.

The aromatic group includes, for example, a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, and the like, and of these, the aromatic group containing a benzene ring is preferred.

The especially preferred aromatic groups as A are benzene and naphthalene.

Aryl groups or unsaturated heterocyclic groups represented by A may have a substituent group. As representative substituent groups, there may be mentioned linear, branched, or cyclic alkyl groups (preferably, with 1 to 20 carbon atoms), aralkyl groups (preferably, monocyclic or bicyclic groups whose alkyl moiety has a carbon atom number of 1 to 3), alkoxy groups (preferably, with 1 to 20 carbon atoms), substituted amino groups (preferably, substituted with an alkyl group of 1 to 20 carbon atoms), acylamino groups (preferably, with 2 to 30 carbon atoms), sulfonamide groups (preferably, with 1 to 30 carbon atoms), ureido groups (preferably, with 1 to 30 carbon atoms), and the like.

A in the general formula (I) may additionally have a ballast group incorporated into it which ballast group is commonly used to render a photographic additive such as a coupler or the like non-diffusible. The ballast group is a group relatively inactive with respect to photographic properties and has a carbon atom number of 8 and over. The ballast group can be selected from among alkyl groups, alkoxy groups, a phenyl group, alkyl phenyl groups, a phenoxy group, alkylphenoxy groups, and the like.

A in the general formula (I) may have a group incorporated into it which group strengthens adsorption to the surface of silver halide grains. As such a group, there may be mentioned groups such as a thiourea group, heterocyclic thioamide groups, mercapto heterocyclic groups, triazole groups, and the like which are disclosed in U.S. Pat. Nos. 4,385,108 and 4,459,347, in Japanese patent application (OPI) Nos. 195233/84, 200231/84, 201045/84, 201046/84, 201047/84, 201048/84, 201049/84, 179734/85, and 170733/86, and U.S. patent application Ser. No. 826,153.

B represents preferably a formyl group, an acyl group (such as an acetyl group, a propionyl group, a trifluoroacetyl group, a chloroacetyl group, a benzoyl group, a 4-chlorobenzoyl group, a pyruvoyl group, a methoxalyl group, a methyloxamoyl group, or the like), an alkyl sulfonyl group (such as a methane sulfonyl group, a 2-chloroethane sulfonyl group, or the like), an aryl sulfonyl group (such as a benzene sulfonyl group, or the like), an alkyl sulfinyl group (such as a methane sulfinyl group or the like), an aryl sulfinyl group (such as a benzene sulfinyl group or the like), a carbamoyl group (such as a methylcarbamoyl group, a phenylcarbamoyl group, or the like), a sulfamoyl group (such as a dimethylsulfamoyl group, or the like), an alkoxycarbonyl group (such as a methoxycarbonyl group, a methoxyethoxycarbonyl group, or the like), an aryloxycarbonyl group (such as a phenoxycarbonyl group, or the like), a sulfinamoyl group (such as a methylsulfinamoyl group, or the like), an alkoxy sulfonyl group (such as a methoxy sulfonyl group, an ethoxy sulfonyl group, or the like), a thioacyl group (such as a methylthiocarbonyl group, or the like), a thiocarbamoyl group (such as a methylthiocarbamoyl group, or the like), or a heterocyclic ring group (such as a pyridine ring, or the like).

A formyl group or an acyl group as B is, in particular, preferred.

B in the general formula (I) together with $R_1$ and a nitrogen atom to which B and $R_1$ are bonded may form the partial structure

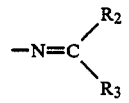

of hydrazone.

In the above formula, $R_2$ represents an alkyl group, an aryl group, or a heterocyclic ring group, and $R_3$ represents a hydrogen atom or an alkyl group, an aryl group, or a heterocyclic ring group.

One of $R_0$ and $R_1$ is a hydrogen atom, and the other is a hydrogen atom, an alkyl sulfonyl group having 20 carbon atoms or less, an aryl sulfonyl group having 20 carbon atoms or less (preferably, a phenyl sulfonyl group or a phenyl sulfonyl group substituted so that the sum of substituent constants of Hammett becomes −0.5 or more), an acyl group having 20 carbon atoms or less (preferably, a benzoyl group, a benzoyl group substituted so that the sum of substituent constants of Hammett becomes −0.5 or more, or an unsubstituted or substituted, linear, branched or cyclic aliphatic acyl group (wherein, as the substituent group, there may be mentioned, for example, halogen atoms, ether groups, sulfonamide groups, carboxylic acid amide groups, hydroxyl group, carboxylic group, sulfonic acid group, and the like).

It is most preferred that both $R_0$ and $R_1$ are hydrogen atoms.

Specific examples of compounds represented by the general formula (I) will be shown hereinafter. However, the invention is not limited to these compounds.

I-1

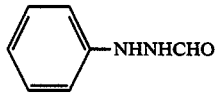

I-2

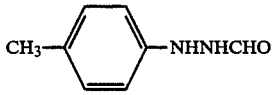

I-3

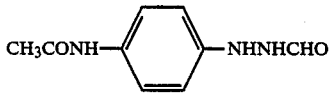

I-4

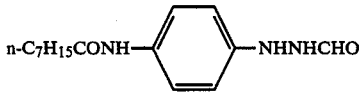

I-5

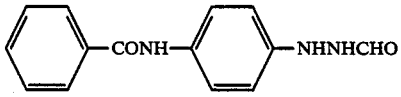

-continued
I-6
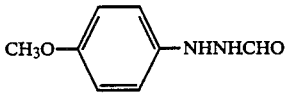
I-7
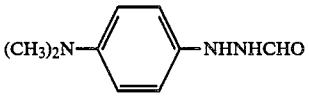
I-8
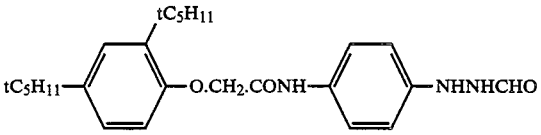
I-9
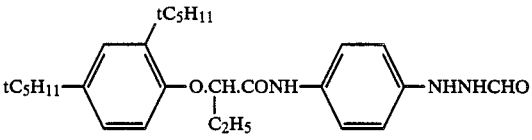
I-10
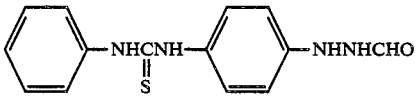
I-11
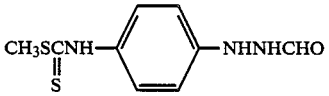
I-12
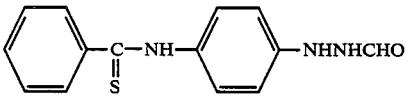
I-13
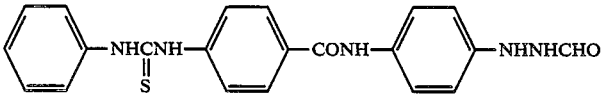
I-14
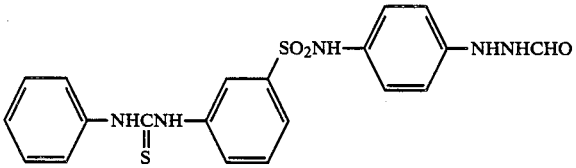
I-15
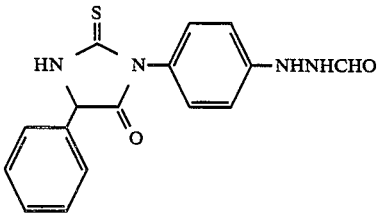
I-16
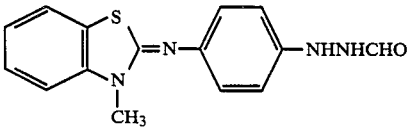

-continued
I-17
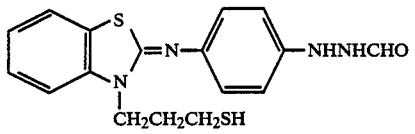
I-18
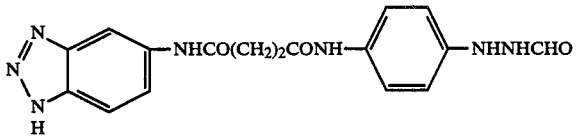
I-19
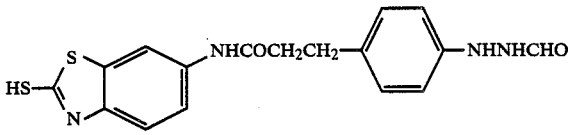
I-20
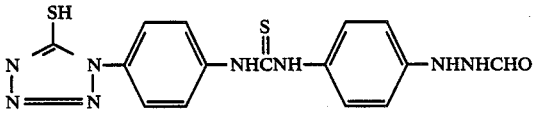
I-21
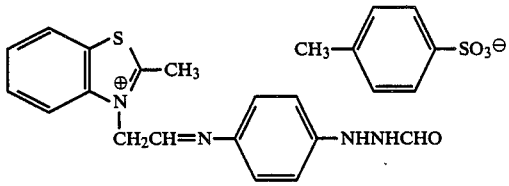
I-22
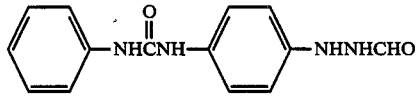
I-23
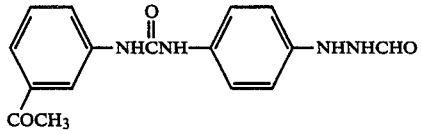
I-24
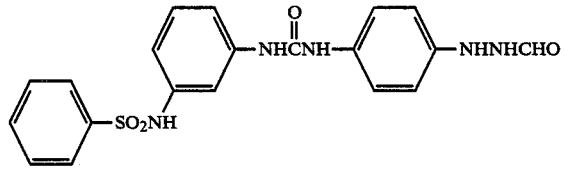
I-25
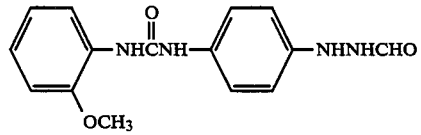
I-26
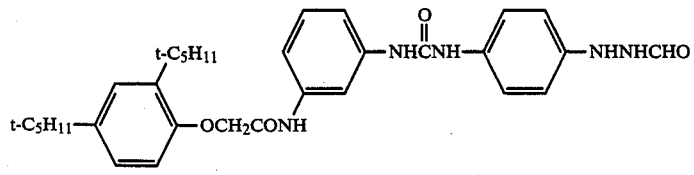

-continued
I-27
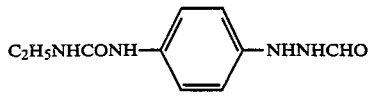
I-28
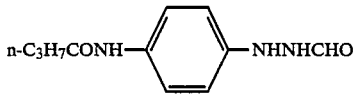
I-29
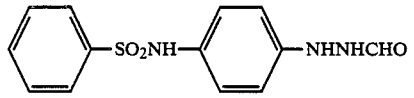
I-30
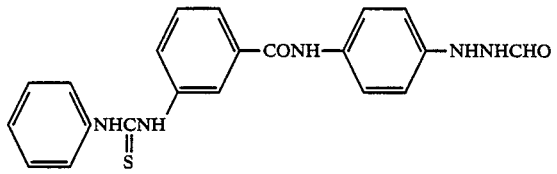
I-31
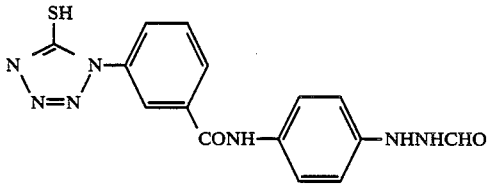
I-32
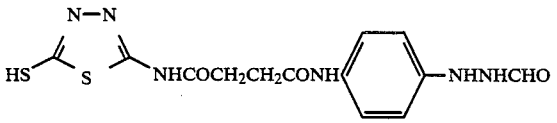
I-33
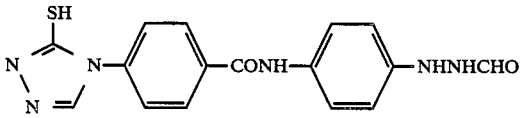
I-34
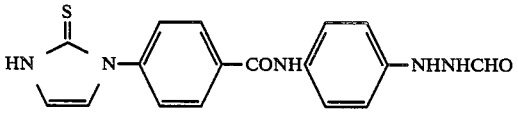
I-35
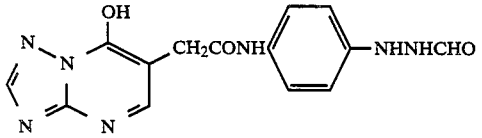
I-36
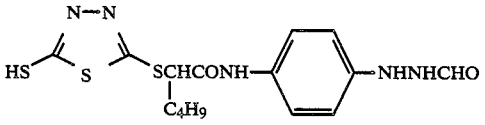
I-37
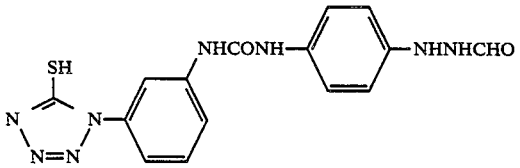

-continued
I-38
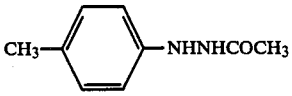
I-40
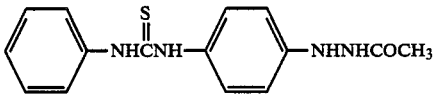
I-41
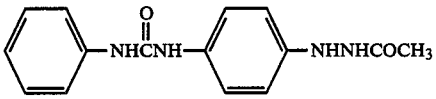
I-42
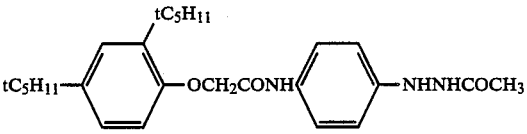
I-43
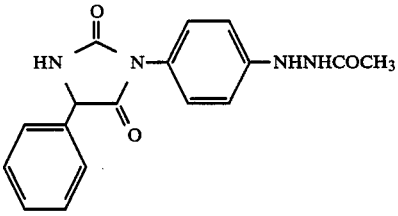
I-44
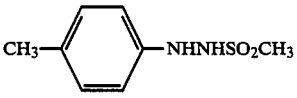
I-45
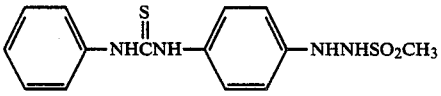
I-46
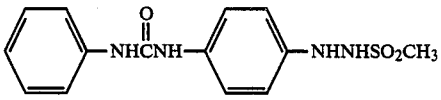
I-47
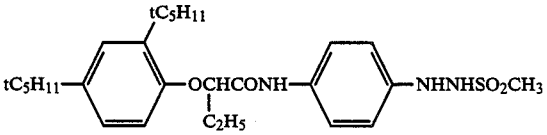
I-48
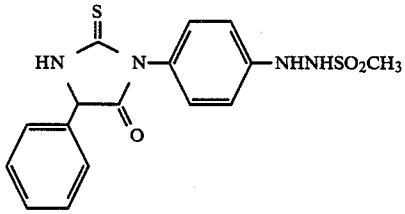
I-49
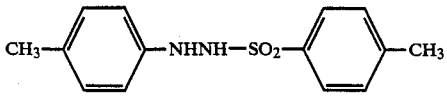

-continued
I-50
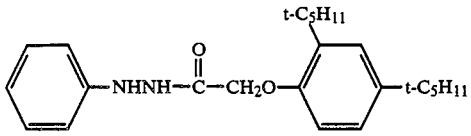
I-51
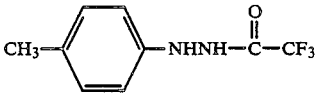
I-52
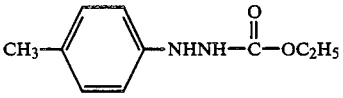
I-53
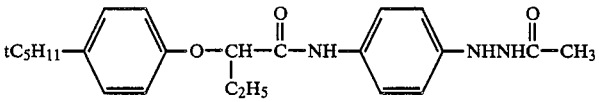
I-54
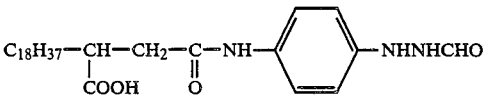
I-55
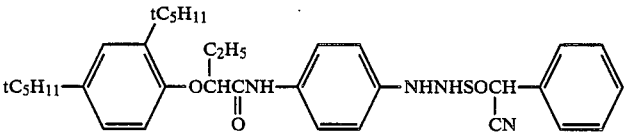
I-56
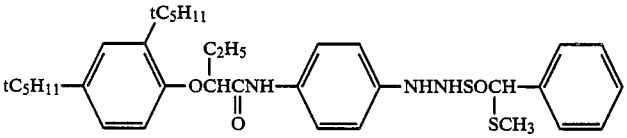
I-57
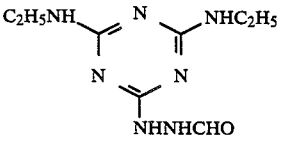
I-58
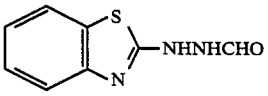
I-59
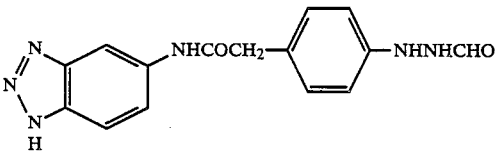
$n\text{-}C_{12}H_{25}$—NHNHCHO I-60
I-61
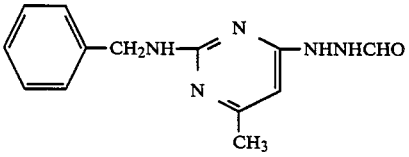

-continued
I-62
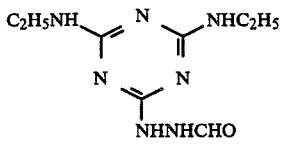
I-63
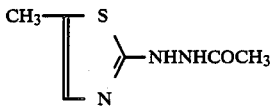
I-64
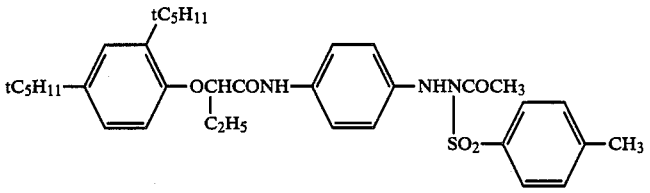
I-65
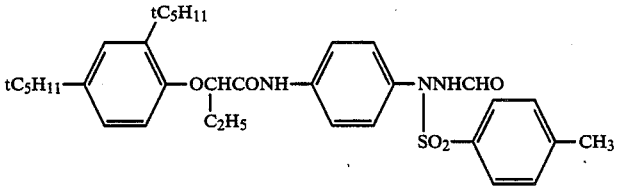
I-66
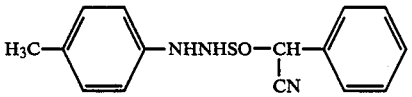
I-67
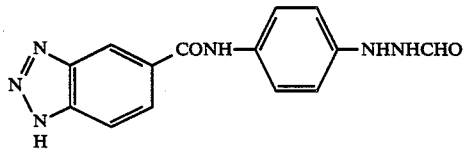
I-68
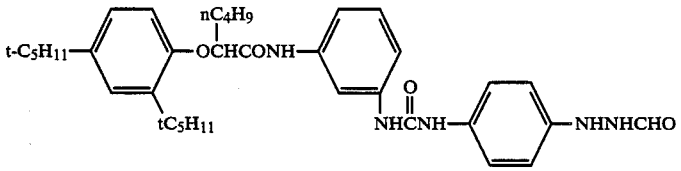
I-69
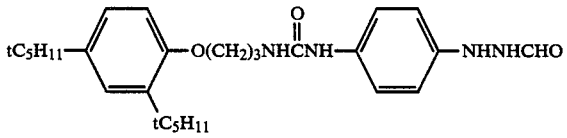
I-70
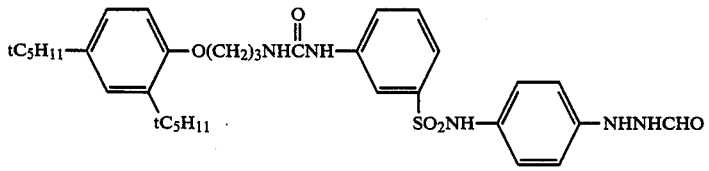

-continued

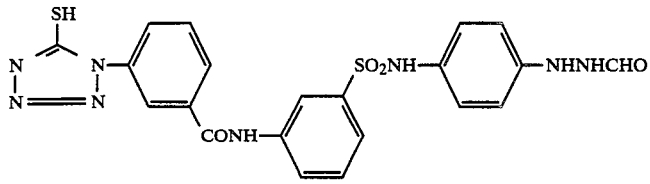

I-71

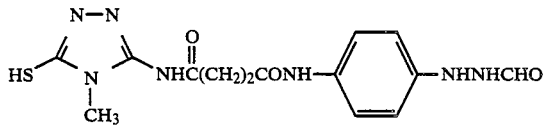

I-72

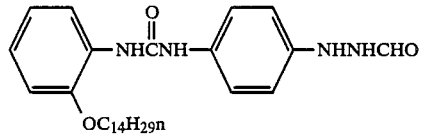

I-73

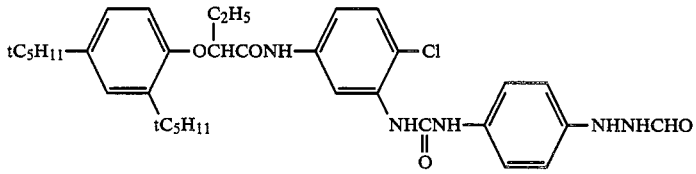

I-74

In addition to the foregoing hydrazine derivatives, those described in *Research Disclosure*, Item 23516 (page 346, November 1983) and references cited therein, U.S. Pat. Nos. 4,080,207, 4,269,929, 4,276,364, 4,278,748, 4,385,108, 4,459,347, 4,560,638 and 4,478,928, British Pat. No. 2,011,391B, and Japanese Patent Application (OPI) No. 179734/85 can be used in the present invention.

The compound represented by the general formula (I) is preferably added in an amount of from $1\times10^{-6}$ mole to $5\times10^{-2}$ mole, particularly from $1\times10^{-5}$ mole to $2\times10^{-2}$ mole, per mole of total silver halide.

Incorporation of a compound represented by the general formula (I) into a photographic material can be achieved by adding the compound to a silver halide emulsive solution or a hydrophilic colloid solution in the form of an aqueous solution when it is soluble in water, or in such a condition as to be dissolved in a water-miscible organic solvent, such as alcohols (e.g., methanol, ethanol, etc.), esters (e.g., ethyl acetate), ketones (e.g., acetone) and so on, when it is insoluble in water.

When the addition to a silver halide emulsive solution is intended, the compound of the general formula (I) can be added at any time, from the beginning of chemical ripening to coating. In particular, it is preferred to add the compound to the coating composition prepared for coating.

Emulsions which can be used in the present invention are described below.

Silver halide grains in the silver halide photographic emulsion is not particularly restricted as to composition. They may have any composition, such as silver chloride, silver chlorobromide, silver iodobromide, etc.

The silver halide emulsions may be chemically sensitized or not. There are known sulfur sensitization, reduction sensitization and noble metal sensitization processes as chemical sensitization processes, and these processes may be employed alone or in combination. Of these processes, a sulfur sensitization process is preferred over others. As a sulfur sensitizer, sulfur compounds contained in gelatins, and various sulfur compounds, such as thiosulfates, thioureas, rhodanines, etc., can be used in the sensitization process. Specific examples of such compounds are described in U.S. Pat. Nos. 1,574,944, 2,278,947, 2,410,689, 2,728,668, 3,501,313 and 3,656,952.

Representative of the noble metal sensitization processes is a gold sensitization process, in which a gold compound, mainly a gold complex salt, is used. Complex salts of noble metals other than gold, e.g., platinum, palladium, rhodium, etc., may be used together. Specific examples of noble metal sensitization processes are described, e.g., in U.S. Pat. No. 2,448,060, British Pat. No. 618,061, and so on.

As reduction sensitizers, stannous salts, amines, formamidine sulfinic acid, silane compounds and so on can be used. Specific examples of such reduction sensitizers are described. e.g., in U.S. Pat. Nos. 2,487,850, 2,518,698, 2,983,609, 2,983,610 and 2,694,637.

A mean grain size of the silver halide is preferably 0.7 μm or less, particularly 0.5 μm or less. The term mean grain size is commonly used by those skilled in the field of silver halide photographic science, and understood easily. The term grain size refers to a grain diameter in case of grains spherical or approximately spherical in shape, while it refers to a value obtained by multiplying an edge length by a factor of $\sqrt{4/\pi}$ in case of cubic grains. In both cases, it is represented by the algebraical or geometrical mean based on projected area of the grains. For details of methods for determining a mean grain size, C. E. K. Mees and T. H. James, *The Theory of the Photographic Process*, 3rd Edition, pp. 36–43, Macmillan Publishing Co. Inc. (1966) should be referred to.

Silver halide grains are not restricted as to shape, and may have any crystal form, e.g., that of a tablet, a sphere, a cube, a tetradecahedron, an octahedron, a rhombic dodecahedron, etc. A grain size distribution is preferably narrow. In particular, a so-called monodispersed emulsion in which 90%, desirably 95%, of the grains have their individual sizes within the range of ±40% of the number average grain size is preferred.

In a process of producing silver halide grains or allowing the produced silver halide grains to ripen physically, cadmium salts, zinc salts, lead salts, thallium salts, rhodium salts or complexes thereof, iridium salts or complexes thereof, and/or the like may be present.

For instance, still higher sensitivity and contrast can be acquired by using an iridium salt or complex thereof in an amount of preferably $10^{-8}$ to $10^{-5}$ mole per mole of silver. Suitable examples of iridium salts or complexes thereof which can be used herein include iridium trichloride, iridium tetrachloride, potassium hexachloroiridate (II), potassium hexachloroiridate (IV), ammonium hexachloroiridate (III), and the like.

Further, image quality can be heightened by rendering a silver halide emulsion contrasty through the addition of a rhodium salt or complex thereof in an amount of preferably $10^{-8}$ to $10^{-3}$ mole, more preferably $5\times10^{-7}$ to $5\times10^{-4}$ mole, per mole of silver. Specific examples of rhodium salts and complexes thereof which can be used for this purpose include rhodium dichloride, rhodium trichloride, potassium hexachlororhodate(III), ammonium hexachlororhodate (III) and the like.

In the present invention, the use of a rhodium salt or complex thereof is preferred.

Suitable methods for reacting a water-soluble silver salt with a water-soluble halide include, e.g., a single jet method, a double jet method or a combination thereof.

Also, a method in which silver halide grains are produced in the presence of excess silver ion (the so-called reverse mixing method) can be employed. Moreover, the so-called controlled double jet method, in which the pAg of the liquid phase in which silver halide grains are to precipitated is maintained constant, may be employed. According to this method, silver halide emulsions having a regular crystal form and an almost uniform grain size can be obtained.

For details of silver halide emulsions and preparation methods thereof references described or cited in *Research Disclosure*, Item 17643, pp. 22–23 (December, 1978) can be referred to.

In the photosensitive material to be used in the present invention, water soluble dyes may be contained as filter dyes, or for various purposes including prevention of irradiation. Such dyes include oxonol dyes, merocyanine dyes, cyanine dyes, azo dyes, and benzylidene dyes, as disclosed in Japanese Patent Application (OPI) Nos. 20822/77, 154439/84 and 208548/84. Among these dyes, oxonol dyes, hemioxonol dyes and merocyanine dyes are useful. Specific examples of dyes usable for the foregoing purposes include those described in British Pat. Nos. 584,609 and 1,177,429, Japanese Patent Application (OPI) Nos. 85130/73, 79620/74 and 114420/74, and U.S. Pat Nos. 2,274,782, 2,533,472, 2,956,879, 3,148,187, 3,177,078, 3,247,127, 3,540,887, 3,575,704, 3,653,905 and 3,718,472.

The photographic material of the present invention may contain a hydroquinone derivative capable of releasing a development inhibitor in proportion to the image density at the time of development (a so-called DIR-hydroquinone) in a photographic emulsion layer or a hydrophilic colloid layer.

As specific examples of such DIR-hydroquinones, mention may be made of compounds as described, e.g., in U.S. Pat. Nos. 3,379,529, 3,620,746 and 4,332,878, Japanese Patent Application (OPI) Nos. 129536/74, 67419/79, 153336/81, 153342/81, 156043/86, 233642/85, 233648/85, and 18946/86, and so on.

To a photosensitive material to be used in the present invention, a sensitizing dye as described in Japanese Patent Application (OPI) No. 52050/80, pp. 45–53 (e.g., a cyanine dye, a merocyanine dye, etc.) can be added for the purpose of increase in sensitivity.

Suitable sensitizing dyes which can be used include cyanine dyes, merocyanine dyes, complex cyanine dyes, complex merocyanine dyes, holopolar cyanine dyes, hemicyanine dyes, styryl dyes, and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and the like nuclei; nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline and like nuclei. Each of these nuclei may be substituted on a carbon atom, too.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

These sensitizing dyes may be used individually or in combination. Combination of sensitizing dyes are often used for the purpose of supersensitization.

Substances which can exhibit a supersensitizing effect in combination with a certain sensitizing dye although they themselves do not spectrally sensitize silver halide emulsions or do not absorb light in the visible region may be incorporated in the emulsion.

In addition to the foregoing description, useful sensitizing dyes, supersensitizing combination of dyes, and substances capable of exhibit a supersensitizing effect in combination with a certain dye are described in *Research Disclosure*, Volume 176, Item 17643, Section IV-A to IV-J, p. 23 (December, 1978).

Sensitizing dyes and the like can be used through the addition to a photographic emulsion at any stage of the production, or at any time within the period from the conclusion of the production till the beginning of the coating. Examples of production stages include grain formation, physical ripening and chemical ripening.

The photographic material used in the present invention can contain a wide variety of compounds for the purposes of preventing fog or stabilizing photographic functions during production, storage, or photographic processing. Specific examples of such compounds include azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc,; mercaptopyrimidines; mercaptotriazines, thioketo compounds like oxazolinethione; azaindenes, such as triazaindenes, tetraazaindenes (especially 4-hydroxy-substituted (1,3,3a,7)-tetraazaindenes), pentaazaindenes, etc.; and compounds which have been known as antifoggants or stabilizers such as benzenethiosulfonic acid, benzenesulfinic acid, benzenesulfonic acid amide, hydroquinone derivatives and so on. Of these compounds, benzotriazoles (e.g., 5-methylbenzotriazole), nitroindazoles (e.g., 5-nitroindazole), and hydroquinone derivatives (e.g., hydroquinone, methylhydroquinone, etc.) are preferred over others. Also, these compounds may be contained in a processing solution.

The photographic material used in the present invention may contain an inorganic or organic hardener in photographic emulsion layers or other hydrophilic colloid layers. Specific examples of such hardeners include chromium salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and so on. These hardeners can be used alone, or as mixture of two or more thereof. Of these hardeners, active vinyl compounds described in Japanese Patent Application (OPI) Nos. 41221/78, 57257/78, 162546/84 and 80846/85, and active halides described in U.S. Pat. No. 3,325,287 are preferred over others.

The photographic emulsion layers and other hydrophilic colloid layers of the photographic material used in the present invention may contain various kinds of surface active agents for a wide variety of purposes, for instance, as a coating aid, prevention of generating of static charges, improvement in sliding property, emulsifying dispersion, prevention of generation of adhesion, improvements in photographic characteristics (e.g., acceleration of development, increase in contrast, sensitization, etc.), and so on.

Examples of suitable surface active agents include nonionic surface active agents such as saponin (steroid type), alkyleneoxide derivatives (e.g., polyethylene glycol, polyethylene glycol/polyethylene glycol condensates, polyethylene glycol alkyl ethers, polyethylene glycol alkyl aryl ethers, polyethylene glycol esters, polyethylene glycol sorbitane esters, polyalkylene glycol alkylamines or amides, polyethylene oxide adducts of silicone, etc.), glycidol derivatives (e.g., alkenylsuccinic acid glyceride, alkylphenol polyglyceride, etc.), fatty acid esters of polyhydric alcohols, alkyl esters of sugars, and so on; anionic surface active agents containing acid groups such as a carboxyl group, a sulfo group, a phospho group, a sulfate group, a phosphate group, etc., for example, alkyl carboxylates, alkyl sulfonates, alkylbenzene sulfonates, alkylnaphthalene sulfonates, alkyl sulfates, alkyl phosphates, N-acyl-N-alkyltaurines, sulfosuccinic acid esters, sulfoalkylpolyoxyethylene alkyl phenyl ethers, polyoxyethylene alkylphosphoric acid esters, and so on; amphoteric surface active agents such as amino acids, aminoalkylsulfonic acids, aminoalkylsulfuric acid or phosphoric acid esters, alkylbetaines, amine oxides, and so on; and cationic surface active agents such as alkylamine salts, aliphatic or aromatic quaternary ammonium salts, heterocyclic quaternary ammonium salts such as pyridinium salts, imidazolium and like salts, aliphatic or heterocyclic phosphonium or sulfonium salts, and so on.

Surface active agents which can be particularly preferably used in the present invention are polyalkylene oxides having a molecular weight of 600 or more described in Japanese Patent Publication No. 9412/83.

When the invention intends to use a surface active agent as antistatic agent, fluorine-containing surface active agents (those described, e.g., in U.S. Pat. No. 4,201,586 and Japanese Patent Application (OPI) No. 80849/85) are particularly preferred.

For the purpose of adhesion prevention, the photographic material used in the present invention can contain a matting agent, such as silica, magnesium oxide, polymethylmethacrylate, etc., in photographic emulsion layers or other hydrophilic colloidal layers.

For the purpose of improvements in dimensional stability and so on, the photographic material to be used in the present invention can contain a dispersion of a synthetic polymer soluble or sparingly soluble in water. For instance, polymers having as a constitutional repeating unit an alkyl(meth)acrylate, an alkoxyalkyl(meth)acrylate, glycidyl(meth)acrylate and the like alone or as combination of two or more thereof, or a combination of such a (meth)acrylate with acrylic acid, methacrylic acid or the like can be used for the foregoing purpose.

It is to be desired that the silver halide emulsion and other layers of the photographic material used in the present invention should contain a compound having an acid group. As examples of acid group-containing compounds, mention may be made of organic acids, such as salicylic acid, acetic acid, ascorbic acid, etc., and homo- and co-polymers having as a constitutional repeating unit an acid monomer such as acrylic acid, maleic acid, phthalic acid, etc. For details of these compounds descriptions in Japanese patent application (OPI) Nos. 22834/86, 228437/86, 25745/87 and 55642/87 can be referred to. Of low molecular-weight compounds, ascorbic acid is particularly preferred over others, while as for the high molecular-weight compounds, water-dispersible latexes of copolymers prepared from acid monomers, such as acrylic acid, and crosslinking monomers having two or more of unsaturated groups, such as divinylbenzene, can produce a particularly desirable effect.

As for the binder or the protective colloid to be used in the photographic material, gelatins are employed to advantage. Hydrophilic synthetic polymers other than gelatin can also be employed. Suitable examples of gelatins which can be used include lime-processed gelatin, acid-processed gelatin, gelatin derivatives, and the like. Detailed descriptions of these gelatins are given in *Research Disclosure,* Vol. 176, No. 17643, Section IX (December, 1978).

In addition to silver halide emulsion layers, the photographic material to be employed in the present invention can have hydrophilic colloid layers such as a surface protective layer, interlayers, a filter layer, an antihalation layer, and so on.

In the protective layer, fine particles of a methylmethacrylate homopolymer, a methylmethacrylate/methacrylate acid copolymer, starch, silica, etc. (particle size: 2 to 5 μm), as described in U.S. Pat. Nos. 2,992,101, 2,701,245, 4,142,894 and 4,396,706, can be contained as matting agent. Further, the above-described surface active agents can be contained together therein.

In addition, the surface protective layer can contain silicone compounds described in U.S. Pat. Nos. 3,489,576 and 4,047,958, colloidal silica described in Japanese Patent Publication No. 23139/81, paraffin waxes, higher fatty acid esters, or starch as a lubricant.

Moreover, polyols such as trimethylolpropane, pentanediol, butanediol, ethylene glycol, glycerine and the like can be used in the hydrophilic colloid layers.

In aiming at acquisition of superhigh contrast and high sensitive photographic characteristics using the silver halide photographic material used in the present invention, it is not required to employ a conventional infectious developer or a high alkaline developer having a pH value near to 13, as described in U.S. Pat. No. 2,419,975, but a stable developer can be employed.

More specifically, the silver halide photographic material can produce a sufficiently superhigh contrast negative image by using a developer which contains not less than 0.15 mol/l of sulfite ion as a preservative, and is adjusted to pH 10.5 to 12.3, particularly pH 11.0 to 12.3.

The developer to be used in the present invention is not particularly restricted as to developing agent. However, it is desirable from the standpoint of facility in imparting excellent dot quality that the developing agent comprises dihydroxybenzenes. In some cases, combinations of dihydroxybenzene and 1-phenyl-3-pyrazolidones, or combinations of dihydroxybenzenes and p-aminophenols are employed.

Dihydroxybenzene type developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, and the like. In particular, hydroquinone is preferred over others.

1-Phenyl-3-pyrazolidone type developing agents which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, and the like.

Developing agents of p-aminophenol type which can be employed in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, and the like. In particular, N-methyl-p-aminophenol is preferred over others.

In general, a developing agent is preferably used in a concentration of 0.05 to 0.8 mol/l. When a combination of a dihydroxybenzene and a 1-phenyl-3-pyrazolidone, or a combination of a dihydroxybenzene and a p-aminophenol is employed as a developing agent, it can produce a desirable result to use the former constituent in a concentration of 0.05 to 0.5 mol/l and the latter one in a concentration of 0.06 mol/l or less.

Specific examples of sulfite type preservatives to be used in the present invention include sodium sulfite, potassium sulfite, lithium sulfite, ammonium sulfite, sodium bisulfite sodium metabisulfate, formaldehyde sodium bisulfite, and the like. A preferred concentration of a sulfite is 0.15 mol/l or more, particularly 0.3 mol/l or more. The upper limit thereof is preferably 2.5 mol/l, particularly preferably 1.2 mol/l.

A preferred concentration of a potassium salt to be used in the present invention is 0.2 mol/l or more, particularly 0.35 mol/l or more.

Alkali agents used for adjustment of pH include pH adjusting agents and buffering agents such as sodium hydroxide, potassium hydroxide, sodium carbonate, potassium carbonate, sodium tertiary phosphate, potassium tertiary phosphate, sodium silicate, potassium silicate, and the like.

Additives, other than the above-described ingredients, which can be contained in the developer include development inhibitors, such as compounds including boric acid, borax and the like, sodium bromide, potassium bromide, potassium iodide, etc.; organic solvents, such as ethylene glycol, diethylene glycol, triethylene glycol, dimethylformamide, methyl cellosolve, hexylene glycol, ethanol, methanol, etc.; antifoggants or black pepper inhibitors, such as mercapto compounds like 1-phenyl5-mercaptotetrazole, sodium 2-mercaptolbenzimidazole-5-sulfonate, etc., indazole compounds like 5-nitroindazole, etc., benzotriazole compounds like 5-methylbenzotriazole, etc., and so on; and optionally, toning agents, surface active agents, defoaming agents, hard water softeners, hardeners, amino compounds described in Japanese patent application (OPI) No. 106224/81, and so on.

In the developer to be used in the present invention, compounds described in Japanese patent application (OPI) No. 24347/81 can be used as silver stain inhibitor, compounds described in U.S. patent application Ser. No. 25757 (filed on Mar. 13, 1987) as uneven development inhibitor, and compounds described in Japanese patent application (OPI) No. 267759/86 as dissolving aid.

In the developer to be used in the present invention, boric acid as described in Japanese patent application No. 28708/86, sugars described in Japanese patent application (OPI) No. 93433/85 (e.g., saccharose), oximes (e.g., acetoxime), phenols (e.g., 5-sulfosalicyclic acid), tertiary phosphates (e.g., sodium tertiary phosphate, potassium tertiary phosphate, etc.), and so on can be contained as a buffering agent. Preferably, boric acid is employed.

A fixer is an aqueous solution containing a fixing agent and optionally, a hardener (e.g., a water-soluble aluminum compound), acetic acid and a dibasic acid (e.g., tartaric acid, citric acid, or salts thereof), and adjusted to pH above 3.8, preferably pH 4.0 to 5.5.

As for the fixing agent, sodium thiosulfate, ammonium thiosulfate and the like can be used herein. In particular, ammonium thiosulfate is used to advantage in terms of fixing speed. An amount of the fixing agent to be used can be changed properly. In general, it ranges from about 0.1 mol/l to about 5 mol/l.

A water-soluble aluminium salt which functions mainly as a hardener in the fixer is a compound known generally as the hardener of acid hardening fixers, and includes, e.g., aluminium chloride, aluminium sulfate, chrome alum, and so on.

As the foregoing dibasic acid, tartaric acid or its derivatives, and citric acid or its derivatives can be used alone or as a combination of two or more thereof. These compounds are effective when contained in an amount of not less than 0.005 mole, particularly from 0.01 to 0.03 mole, per liter of fixer.

Specific examples of such dibasic acids include tartaric acid, potassium tartarate, sodium tartarate, potassium sodium tartarate, ammonium tartarate, ammonium potassium tartarate, and so on.

As examples of citric acid derivatives effective in the present invention, mention may be made of sodium citrate, potassium citrate, and so on.

Further, the fixer can optionally contain preservatives (e.g., sulfites, bisulfites, etc.), pH buffering agents (e.g., acetic acid, boric acid, etc.), pH adjusting agents (e.g., ammonia, sulfuric acid, etc.), image-keeping quality enhancing agents (e.g., potassium iodide), and chelating agents. Herein, a pH buffering agent is used in an amount of about 10 to 40 g, preferably 18 to 25 g, per liter of fixer because of high pH of the developer.

A temperature and a time for fixation are the same as for development, and about 20° C. to about 50° C. and 10 seconds to 1 minute are preferred, respectively.

Washing water may contain bactericides (e.g., compound as described in H. Horiguchi, *Bokin Bobai no Kagaku* (Antibacterial and Antifungal Chemistry), and Japanese patent application (OPI) No. 115154/87), washing accelerators (e.g., sulfites, etc.), chelating agents, and so on.

The photographic material which has received development and fixation processings in the above-described manners is washed and dried. Washing is carried out in order to remove almsot completely silver salts dissovled by fixation. Preferably, it takes from 10 seconds to 3 minutes at about 20° C. to about 50° C. to achieve the washing. Drying is carried out at about 40° C. to about 100° C., and a drying time can be changed properly depending on condition of the surroudings. In general, it may range from about 5 seconds to 3 minutes and 30 seconds.

A roller carrier type automatic developing machine is described, e.g., in U.S. Pat. Nos. 3,025,779 and 3,545,971, and so on, and referred to simply as a roller carrier type processor in this specification. The roller carrier type processor is constructed by four units for development, fixation, washing and drying processes, respectively. In the method of the present invention also, though other processes (e.g., stop process) are not excluded, it is most desirable to follow these four processes. Herein, water can be saved by applying a two- or three-stage counter current washing method to the washing process.

It is to be desired upon storage that the developer to be used in the present invention should be wrapped with a material low in oxygen permeation rate, as described in Japanese patent application (OPI) No. 73147/86. To the developer which can be used in the present invention, the replenishing system described in Japanese patent application (OPI) No. 91939/87 can be applied.

When received a reduction processing after image formation, the silver halide photographic material used in the present invention can retain high density notwithstanding a decrease in dot area, because it has a capacity for providing high $D_{max}$.

The present invention is not particularly restricted as to reducing solution to be used. Reducing solutions which can be used are, for example, those described in publications written by, e.g., C. E. K. Mees, *The Theory of the Photographic Process*, pp. 738–744, Macmillan, New York (1954), Tesuo Yano, *Shashin Shori-Shono Riron to Jissai* (Photographic Processing, Its Theory and Practice), pp. 166–169, Kyoritsu Shuppan, Tokyo (1978), etc., and Japanese patent application (OPI) Nos. 27543/75, 68429/77, 17123/80, 79444/80, 10140/82, 142639/82, and 61155/86, and so on. More specifically, a reducing solution containing a permanganate, a persulfate, a ferric salt, a cupric salt, a ceric salt, a hexacyanoferrate(III), a dichromate and the like individually or in combination as an oxidizing agent, and optionally an inorganic acid like sulfuric acid, and an alcohol; a reducing solution containing an oxidizing agent such as a hexacyanoferrate(III), an ethylenediaminetetraacetatoferrate(III) or the like, a silver halide solvent such as a thiosulfate, a rhodanide, thiourea or a derivative thereof, or so on, and optionally an inorganic acid like sulfuric acid; and the like can be employed.

The representatives of reducing solutions which can be used in the present invention are the so-called Farmer's reducer, an ethylenediaminetetraacetatoferrate(III) reducer, a potassium permanganate reducer, an ammonium persulfate reducer (Kodak R-5), and a ceric salt reducer.

The reduction processing is preferably completed in several seconds to several decades minutes, particularly to several minutes, at a temperature of generally 10° C. to 40° C., particularly 15° C. to 30° C. Within the limits of the foregoing condition, a sufficiently broad range of reduction can be obtained by using the photographic material for photomechanical use of the present invention.

The reducer is made to act on silver image formed in an emulsion layer through the light-insensitive upper layer containing the compound of the present invention.

The reduction can be carried out in various manners. For example, the photographic material for photomechanical use is soaked in a reducer with stirring, or a reducer is applied to the surface of the photographic material for photomechanical use using a brush, a roller or the like.

The invention will be described in detail referring to the following non-limiting examples.

Unless otherwise indicated herein, all parts, percents, ratios and the like are by weight.

EXAMPLE 1

Silver chloroiodobromide emulsions (having a silver iodide content of 0.1 mol% and a silver bromide content of 30 mol%) were prepared using a double jet method. In preparing the emulsions, $(NH_4)_3RhCl_6$ was added as a rhodium salt to aqueous halide solutions in various amounts described in Table 1-(1), respectively. At the same time, $K_3IrCl_6$ was further added as an iridium salt to each aqueous halide solution in such an amount that the content in the resulting emulsion became $4\times10^{-7}$ mol/mol Ag. Each of the resulting aqueous halide solutions was mixed with the aqueous solution of silver nitrate at 45° C. for 60 minutes to prepare the monodispersed cubic silver chloroiodobromide emulsion having a mean grain size of 0.25 μm.

After desalting by washing, each emulsion was subjected to sulfur sensitization using sodium thiosulfate and gold sensitization using potassium chloroaurate in amounts set forth in Table 1-(1), respectively.

To the resulting emulsions each were further added $3\times10^{-4}$ mol/mol Ag of potassium salt of 1-(2-hydroxyethoxyethyl)-3-(pyridine-2-yl)-5-[(3-sulfobutyl-5-chloro-2-benzoxazolinidene)ethylidene]-2-thiohydantoin as a sensitizing dye, and 1.5 g/mol Ag of 4-hydroxy-6-methyl-1,3,3a,7-tetrazaindene, 2 g/mol Ag of hydroquinone, 2 g/mol Ag of resorcinaldoxime and 0.1 g/mol Ag of 1-phenyl-5-mercaptotetrazole as stabilizers.

Furthermore, saponin and the compound with the formula, $$C_{17}H_{33}CON(CH_3)-CH_2CH_2SO_3Na,$$

were added as coating aids to each of the emulsions, the compound with the formula, $$CH_2{=}CHSO_2CH_2CONH(CH_2)_nNHCOCH_2SO_2CH{=}CH_2 (n=2,3),$$

as a hardener of vinylsulfonic acid type, sodium polystyrenesulfonate as a thickener, and a dispersion of polyethylacrylate as a latex polymer.

In addition, the hydrazine compound with the formula,

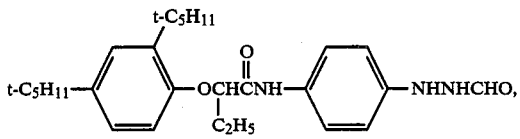

was added to the emulsions in amounts set forth in Table 1-(1), respectively.

In order to form a protective layer, an aqueous gelatin solution containing gelatin, sodium dodecylbenzenesulfonate, silicone oil, colloidal silica, a polyethylacrylate dispersion, polymethylmethacrylate particles (size: 2.5 μm) as matting agent, and sodium polystyrenesulfonate as thickener was prepared. This gelatin solution and each of the foregoing emulsions were coated at coverages of 1.6 g/m$^2$ on a gelatin basis and 3.6 g/m$^2$ on a silver basis, respectively, using a simultaneous coating technique. Thus, a protective layer and an emulsion layer were formed.

Each sample thus obtained was exposed to tungsten light of 3200° K. for 5 seconds through an optical wedge for sensitometry, and then subjected successively to 30 seconds' development at 38° C. with a developer having the following composition, fixation, washing and drying (the development-processing was carried out using an automatic developing machine FG-660F manufactured by Fuji Photo Film, Co., Ltd.).

| Composition of Developer: | |
|---|---|
| Hydroquinone | 35.0 g |
| N—Methyl-p-aminophenol ½ · Sulfate | 0.8 g |
| Sodium Hydroxide | 9.0 g |
| Potassium Tertiary Phosphate | 74.0 g |
| Potassium Sulfite | 90.0 g |
| Disodium Ethylenediaminetetraacetate | 1.0 g |
| Potassium Bromide | 3.0 g |
| 5-Methylbenzotriazole | 0.6 g |
| 3-Diethylamino-l-propanol | 15.0 g |
| Water to make | 1 liter (pH = 11.6) |

Another developer was prepared by adding acetic acid to the above-described developer in such an amount as to arrive at a pH lower by a value of 1.0. By using this developer adjusted to pH 10.6 each sample was development-processed in the same manner as described above.

The results obtained are described in Table 1-(2).

TABLE 1-(1)

| Sample No. | Rh Salt (mol/mol Ag) | Sodium Thiosulfate (mol/mol Ag) | Potassium Chloroaurate (mol/mol Ag) | Hydrazine Compound (mol/mol Ag) |
|---|---|---|---|---|
| 1 | $1 \times 10^{-5}$ | $5 \times 10^{-5}$ | $1 \times 10^{-5}$ | $2 \times 10^{-4}$ |
| 2 | " | " | " | $6 \times 10^{-4}$ |
| 3 | " | " | " | $1.8 \times 10^{-3}$ |
| 4 | " | " | $4 \times 10^{-5}$ | $2 \times 10^{-4}$ |
| 5 | " | " | " | $6 \times 10^{-4}$ |
| 6 | " | " | " | $1.8 \times 10^{-3}$ |
| 7 | $5 \times 10^{-5}$ | $1 \times 10^{-5}$ | $1 \times 10^{-5}$ | $2 \times 10^{-4}$ |
| 8 | " | " | " | $6 \times 10^{-4}$ |
| 9 | " | " | " | $1.8 \times 10^{-3}$ |
| 10 | " | " | $4 \times 10^{-5}$ | $2 \times 10^{-4}$ |
| 11 | " | " | " | $6 \times 10^{-4}$ |
| 12 | " | " | " | $1.8 \times 10^{-3}$ |
| 13 | " | $5 \times 10^{-5}$ | $1 \times 10^{-5}$ | $2 \times 10^{-4}$ |
| 14 | " | " | " | $6 \times 10^{-4}$ |
| 15 | " | " | " | $1.8 \times 10^{-3}$ |
| 16 | " | " | $4 \times 10^{-5}$ | $2 \times 10^{-4}$ |
| 17 | " | " | " | $6 \times 10^{-4}$ |
| 18 | " | " | " | $1.8 \times 10^{-3}$ |
| 19 | $9 \times 10^{-5}$ | $1 \times 10^{-5}$ | $1 \times 10^{-5}$ | $2 \times 10^{-4}$ |
| 20 | " | " | " | $6 \times 10^{-4}$ |
| 21 | " | " | " | $1.8 \times 10^{-3}$ |
| 22 | $9 \times 10^{-5}$ | $1 \times 10^{-5}$ | $4 \times 10^{-5}$ | $2 \times 10^{-4}$ |
| 23 | " | " | " | $6 \times 10^{-4}$ |
| 24 | " | " | " | $1.8 \times 10^{-3}$ |
| 25 | " | $5 \times 10^{-5}$ | $1 \times 10^{-5}$ | $2 \times 10^{-4}$ |
| 26 | " | " | " | $6 \times 10^{-4}$ |
| 27 | " | " | " | $1.8 \times 10^{-3}$ |
| 28 | " | " | $4 \times 10^{-5}$ | $2 \times 10^{-4}$ |
| 29 | " | " | " | $6 \times 10^{-4}$ |
| 30 | " | " | " | $1.8 \times 10^{-3}$ |

TABLE 1-(2)

| Sample No. | 3.35 Δlog E | γ1 | γ2 | Latitude of Line Original Exposure | $D_{max}$ in Practical Technique | Remarks |
|---|---|---|---|---|---|---|
| 1 | 0.43 | 8.5 | 3.7 | 1.07 | 3.15 | Comparison |
| 2 | 0.69 | 12 | 3.8 | 0.92 | 4.20 | " |
| 3 | 0.91 | 14 | 3.8 | 0.86 | 4.25 | " |
| 4 | 0.52 | 9.3 | 4.0 | 1.03 | 3.42 | " |
| 5 | 0.86 | 13 | 4.1 | 0.75 | 4.05 | " |
| 6 | 1.12 | 16 | 4.0 | 0.68 | 4.26 | " |
| 7 | 0.35 | 8.2 | 5.5 | 1.15 | 3.30 | " |
| 8 | 0.62 | 11 | 5.5 | 1.12 | 4.23 | Invention |
| 9 | 0.95 | 14 | 5.6 | 0.73 | 4.20 | Comparison |
| 10 | 0.42 | 8.5 | 5.6 | 1.10 | 3.45 | " |
| 11 | 0.57 | 12 | 5.6 | 1.13 | 4.19 | Invention |
| 12 | 0.68 | 15 | 5.6 | 1.10 | 4.32 | " |
| 13 | 0.51 | 7.6 | 5.4 | 1.16 | 3.15 | Comparison |
| 14 | 0.69 | 11 | 5.5 | 1.25 | 4.15 | Invention |
| 15 | 1.23 | 15 | 5.5 | 0.64 | 4.20 | Comparison |
| 16 | 0.52 | 12 | 5.6 | 1.20 | 4.27 | Invention |
| 17 | 0.70 | 14 | 5.7 | 1.14 | 4.30 | " |
| 18 | 0.95 | 17 | 5.7 | 0.55 | 4.35 | Comparison |
| 19 | 0.45 | 7.0 | 6.3 | 1.12 | 3.10 | " |
| 20 | 0.63 | 9.5 | 6.3 | 1.07 | 3.3 | " |
| 21 | 0.68 | 13 | 6.3 | 1.13 | 4.25 | Invention |
| 22 | 0.48 | 8.5 | 6.5 | 1.15 | 3.31 | Comparison |
| 23 | 0.62 | 11 | 6.4 | 1.26 | 4.20 | Invention |
| 24 | 0.69 | 14 | 6.5 | 1.21 | 4.36 | " |
| 25 | 0.42 | 8.3 | 6.3 | 1.20 | 3.25 | Comparison |
| 26 | 0.58 | 12 | 6.2 | 1.20 | 4.23 | Invention |
| 27 | 0.69 | 16 | 6.2 | 1.14 | 4.40 | " |
| 28 | 0.37 | 8.0 | 6.7 | 1.17 | 3.20 | Comparison |
| 29 | 0.59 | 11 | 6.6 | 1.24 | 4.17 | Invention |
| 30 | 0.67 | 15 | 6.7 | 1.10 | 4.32 | " |

Note in Table 1-(2)

Method of Evaluating Latitude of Line Original Exposure

An original on which white and black lines having a line width of 100 μm are drawn is prepared using hand-operated photocomposition paper PL-100 WP (made by Fuji Photo Film Co., Ltd.). The term white lines as used herein refers to white lines on a solid black background, and the term black lines as used herein refers to black lines drawn on a white background. The line width of these black and white lines is ascertained to be 100 μm by measuring a line width at the position of optical density=0.6 as the original is scanned in the direction perpendicular to the white lines with a reflection microdensitometer. Photographs of the thus obtained original which has white and black lines drawn on the hand-operated photocomposition paper are taken in the samples described in the examples with a reflex process camera DSC-351 (made by Dainippon Screen Mfg. Co., Ltd.), followed by development-processing. The limiting exposure upon white reproduction and the limiting exposure upon black line reproduction are determined respectively by carrying out the exposure step changing variously an exposure time (the number of seconds) of the process camera, and the difference between these two values is taken as exposure latitude. That is, in proportion as an exposure is reduced to a lower value, the white lines of the original (which become black lines on a negative film) get thinner and their densities get lower though the black lines of the original (which become white lines on the negative film) can be reproduced, and finally the lower limit of the exposure under which white line cannot be reproduced any longer can be found. In analogy with the lower limit, the upper limit of the exposure under which the black lines of the original become too thin to be reproduced though the white lines are reproduced in a satisfactory condition can be found as an exposure is raised successively. A difference between the thus determined upper and lower limits is taken as latitude of line original exposure. Thus, a large difference in exposure signifies a wide latitude, and brings about a good result. The limiting points of the white lines and the black lines are decided by determining exposures under which the widths of their corresponding lines at the position of optical density=1.5 on the developed negative film are not more than 10 μm (which is such a line width as not to be employed in the subsequent process) when the negative film is scanned in the direction of line width with a transmission microdensitometer.

A latitude of line original exposure can be represented by the following relation:

$$\text{Latitude of line original exposure} = \log(\text{upper limit exposure}) - \log(\text{lower limit exposure})$$

Method of Evaluating $D_{max}$ in Practical Techniques

A high density is preferred in a black solid area on the developed negative film. It is on the low exposure side that a density of the black solid area become a problem to be solved, a transmission density of the black solid area under the limiting exposure (the lower limit exposure) condition where the white lines of the original can be reproduced is measured with a Macbeth densitometer TD-504, and the value obtained is taken as $D_{max}$ in practical technique.

The $D_{max}$ in practical technique is preferably 4.0 or more.

Method of Evaluating Sensitivity

The logarithm of an exposure corresponding to fog+density 2.0 on the characteristic curve obtained by the sensitometry described in the examples is read, and thereby sensitivity is determined.

Method of Evaluating Gamma (γ)

The point of fog+density 0.3 and the point of fog+density 3.0 on the characteristic curve are connected by straight line, and the gamma value is determined as the slope of this straight line. That is, $$\gamma = \frac{3.0 - 0.3}{\log(\text{exposure corresponding to fog + density 3.0}) - \log(\text{exposure corresponding to fog + density 0.3})}$$

The gamma value obtained in the standard processing where the developer used was adjusted to pH 11.6 was denoted as $\gamma_1$, and the gamma value obtained using the developer prepared so as to have a pH value lowered by 1.0, i.e., pH 10.6 was denoted as $\gamma_2$.

A difference between the sensitivities acquired using the foregoing two developers was represented by Δ log E.

A desirable latitude of line original exposure is 1.0 or above, and a desirable $D_{max}$ in practical technique is 4.0 or above.

As can be clearly seen from the data in Table 1-(2), the samples of the present invention were able to acquire a wide latitude of line original exposure and a high $D_{max}$ in practical technique.

EXAMPLE 2

Monodispersed cubic silver iodobromide emulsions having a mean silver iodide content of 1.0 mol% (grain size: 0.20 μm) were prepared in the same manner as in Example 1. Into these emulsions, $K_3IrCl_6$ was incorporated as an iridium salt in an amount of $7\times10^{-7}$ mol/mol Ag, and $(NH_4)_3RhCl_6$ as a rhodium salt in amounts set forth in Table 2-(1), respectively, in the same manner as in Example 1. After each emulsion was subjected to sulfur sensitization using sodium thiosulfate and gold sensitization using potassium chloroaurate in amounts set forth in Table 2-(1), respectively, it is spectrally sensitized by the addition of sodium salt of 5,5'-dichloro-3,3'-di(3-sulfopropyl)-9-ethyloxacarbocyanine as a sensitizing dye in an amount of $6\times10^{-4}$ mol/mol Ag. Further, 0.8 g of 4-hydroxy-6-methyl-1,3,3a,7-tetrazaindene, 0.2 g of 1-phenyl-5-mercaptotetrazole, 1,2 g of L-ascorbic acid and 0.1 g of 5-methyl-benzotriazole were added as stabilizers, and furthermore, saponin and the compound described in Example 1 as coating aids, and the same vinylsulfonic acid type hardener and thickener as used in Example 1 were added.

In addition, a polyethylacrylate dispersion as latex polymer, a water-dispersible latex of acrylic acid/divinylbenzene copolymer, and the hydrazine compound of the formula,

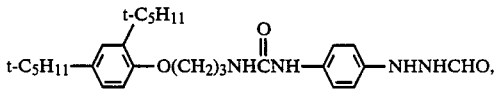

in amounts set forth in Table 2-(1) respectively were added.

A protective layer is formed using the same coating composition and coating technique as described in Example 1.

The development was carried out under the same condition as in Example 1. Samples were evaluated in the same way as in Example 1. The results obtained are shown in Table 2-(2).

TABLE 2-(1)

| Sample No. | Rh Salt (mol/mol Ag) | Sodium Thiosulfate (mol/mol Ag) | Potassium Chloroaurate (mol/mol Ag) | Hydrazine Compound (mol/mol Ag) |
|---|---|---|---|---|
| 31 | $3 \times 10^{-5}$ | $2 \times 10^{-5}$ | — | $6 \times 10^{-4}$ |
| 32 | " | " | — | $1.2 \times 10^{-3}$ |
| 33 | " | " | $4 \times 10^{-5}$ | $6 \times 10^{-4}$ |
| 34 | " | " | " | $1.2 \times 10^{-3}$ |
| 35 | " | $6 \times 10^{-5}$ | — | $6 \times 10^{-4}$ |
| 36 | " | " | — | $1.2 \times 10^{-3}$ |
| 37 | " | " | $4 \times 10^{-5}$ | $6 \times 10^{-4}$ |
| 38 | " | " | " | $1.2 \times 10^{-3}$ |
| 39 | $6 \times 10^{-5}$ | $2 \times 10^{-5}$ | — | $6 \times 10^{-4}$ |
| 40 | " | " | — | $1.2 \times 10^{-3}$ |
| 41 | " | " | $4 \times 10^{-5}$ | $6 \times 10^{-4}$ |
| 42 | " | " | " | $1.2 \times 10^{-3}$ |
| 43 | " | $6 \times 10^{-5}$ | — | $6 \times 10^{-4}$ |
| 44 | " | " | — | $1.2 \times 10^{-3}$ |
| 45 | " | " | $4 \times 10^{-5}$ | $6 \times 10^{-4}$ |
| 46 | " | " | " | $1.2 \times 10^{-3}$ |

TABLE 2-(2)

| Sample No. | Δlog E | γ1 | γ2 | Latitude of Line Original Exposure | $D_{max}$ in Practical Technique | Remarks |
|---|---|---|---|---|---|---|
| 31 | 0.47 | 7.4 | 5.7 | 0.95 | 3.12 | Comparison |
| 32 | 0.61 | 13 | 5.6 | 1.12 | 4.25 | Invention |
| 33 | 0.54 | 12 | 3.9 | 1.10 | 3.85 | Comparison |
| 34 | 0.95 | 17 | 4.1 | 0.78 | 4.20 | " |
| 35 | 0.50 | 9.5 | 4.2 | 1.02 | 3.45 | " |
| 36 | 0.75 | 13 | 4.0 | 0.95 | 3.86 | " |
| 37 | 0.43 | 11 | 5.4 | 1.20 | 4.10 | Invention |
| 38 | 0.60 | 16 | 5.7 | 1.17 | 4.37 | " |
| 39 | 0.40 | 8.7 | 5.5 | 1.15 | 3.52 | Comparison |
| 40 | 0.59 | 12 | 5.6 | 1.16 | 4.15 | Invention |
| 41 | 0.67 | 13 | 5.4 | 1.08 | 4.22 | " |
| 42 | 1.05 | 19 | 5.3 | 0.51 | 4.35 | Comparison |
| 43 | 0.52 | 10 | 4.2 | 1.03 | 3.65 | " |
| 44 | 0.75 | 14 | 4.3 | 0.82 | 4.05 | " |
| 45 | 0.50 | 12 | 5.4 | 1.21 | 4.10 | Invention |
| 46 | 0.68 | 15 | 5.9 | 1.17 | 4.26 | " |

As can be seen from the data shown in Table 2-(2), the samples of the present invention satisfied both requirements, i.e., such a wide latitude of line original exposure as to exceed 1.0 and such a high $D_{max}$ in practical technique as to exceed 4.0.

EXAMPLE 3

Samples were prepared in the same manner as Sample No. 8 in Example 1 except that kinds and addition amounts of hydrazine compounds were so changed as described in Table 3. The hydrazine compounds were selected from among the examples of the compounds represented by the general formula (I).

Samples were evaluated in the same way as in Example 1.

The results obtained are shown in Table 3.

TABLE 3

| Sample No. | Hydrazine Compound Kind | Hydrazine Compound Amount Added (mol/mol Ag) | Δlog E | γ1 | γ2 | Latitude of Line Original Exposure | $D_{max}$ in Practical Technique | Remarks |
|---|---|---|---|---|---|---|---|---|
| 47 | I-13 | $1 \times 10^{-4}$ | 0.48 | 8.5 | 5.4 | 1.07 | 3.62 | Comparison |
| 48 | " | $3 \times 10^{-4}$ | 0.62 | 12 | 5.5 | 1.18 | 4.20 | Invention |
| 49 | I-14 | $5 \times 10^{-5}$ | 0.59 | 11 | 5.5 | 1.20 | 4.15 | Invention |
| 50 | " | $9 \times 10^{-5}$ | 0.65 | 14 | 5.6 | 1.15 | 4.32 | " |
| 51 | I-16 | $2 \times 10^{-4}$ | 0.51 | 12 | 5.4 | 1.17 | 4.23 | " |
| 52 | " | $5 \times 10^{-4}$ | 0.63 | 16 | 5.4 | 1.09 | 4.37 | " |
| 53 | I-18 | $6 \times 10^{-4}$ | 0.43 | 9.0 | 5.6 | 1.05 | 3.70 | Comparison |
| 54 | " | $1.5 \times 10^{-3}$ | 0.58 | 12 | 5.5 | 1.08 | 4.15 | Invention |
| 55 | I-26 | $5 \times 10^{-5}$ | 0.41 | 7.5 | 5.4 | 1.05 | 3.62 | Comparison |
| 56 | " | $1 \times 10^{-4}$ | 0.53 | 11 | 5.5 | 1.12 | 4.13 | Invention |
| 57 | I-32 | $3 \times 10^{-5}$ | 0.47 | 12 | 5.4 | 1.15 | 4.18 | " |
| 58 | " | $9 \times 10^{-5}$ | 0.60 | 14 | 5.4 | 1.07 | 4.25 | " |
| 59 | I-37 | $2 \times 10^{-5}$ | 0.42 | 8.7 | 5.6 | 1.10 | 3.68 | Comparison |
| 60 | " | $6 \times 10^{-5}$ | 0.55 | 12 | 5.6 | 1.25 | 4.15 | Invention |
| 61 | I-56 | $3 \times 10^{-4}$ | 0.52 | 11 | 5.5 | 1.28 | 4.10 | Invention |
| 62 | " | $8 \times 10^{-4}$ | 0.63 | 13 | 5.6 | 1.13 | 4.27 | " |
| 63 | I-69 | $3 \times 10^{-4}$ | 0.43 | 12 | 5.4 | 1.18 | 4.20 | " |
| 64 | " | $8 \times 10^{-4}$ | 0.58 | 15 | 5.4 | 1.07 | 4.32 | " |
| 65 | I-72 | $1 \times 10^{-5}$ | 0.37 | 6.8 | 5.4 | 1.08 | 3.48 | Comparison |
| 66 | " | $3 \times 10^{-5}$ | 0.45 | 11 | 5.5 | 1.20 | 4.10 | Invention |

As can be seen from the data in Table 3, all the samples of the present invention were excellent in both latitude of line original exposure and $D_{max}$ in practical technique similarly to Sample No. 8.

While the invention has been described in detail and with reference to specific embodiments thereof, it will be apparent to one skilled in the art that various changes and modifications can be made therein without departing from the spirit and scope thereof.

What is claimed is:

1. A method of forming an image comprising the steps of:

(a) imagewise exposing a photographic material which comprises a support having provided thereon at least one light-sensitive silver halide emulsion layer and which contains a hydrazine compound represented by the following general formula (I) in said emulsion layer or a hydrophilic colloid layer adjacent thereto:

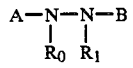

(I)

wherein A represents a substituted or unsubstituted aliphatic group, or a substituted or unsubstituted aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, a sulfamoyl group, or a heterocyclic group; both $R_0$ and $R_1$ represent a hydrogen atom, or one of them represents a hydrogen atom and the other represents a substituted or unsubstituted alkylsulfonyl group, a substituted or unsubstituted arylsulfonyl group, or a substituted or unsubstituted acyl group; and B, $R_1$ and the nitrogen atom attached thereto may form a partial structure of hydrazone,

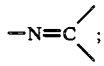

and (b) developing said exposed material with a developer (A) having a sulfite ion concentration of 0.15 mole/l or more, a potassium ion concentration of 0.2 mole/l or more, and a pH value ranging from 10.5 to 12.3; wherein a gamma value of said material developed with developer (A) is at least 10, a gamma value of said material developed with a developer (B) that is the same as the developer (A) except that the pH value is lowered by 1.0 is at least 5, and a difference in sensitivity between said material developed with the developer (A) and that developed with the developer (B) is at most 0.7 wherein the sensitivity is defined as log E corresponding to the density of fog+2.0.

2. A method as in claim 1, wherein the potassium ion concentration is 0.35 mol/l or more.

3. A method as in claim 1, wherein said developer (A) has a pH within the range of from 11.0 to 12.3.

4. A method as in claim 1, wherein said sulfite ion concentration is 0.3 mol/l or more.

5. A method of forming an image as in claim 1, wherein said developer (A) comprises dihydroxybenzenes.

6. A method as in claim 5, wherein said developer (A) is selected from the group consisting of hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone.

7. A method as in claim 1, wherein said silver halide emulsion further contains from $10^{-8}$ to $10^{-3}$ mole per mole of silver of a rhodium salt or rhodium salt complex.

8. A method as in claim 1, wherein said developer (A) has a pH of 11.6.

9. A method as in claim 1, wherein the amount of said compound represented by the general formula (I) is from $1\times10^{-6}$ mole to $5\times10^{-2}$ mole per mole of total silver halide.

10. A method as in claim 1, wherein the amount of said compound represented by the general formula (I) is from $1\times10^{-5}$ mole to $2\times10^{-2}$ mole per mole of total silver halide.

* * * * *